US005974616A

United States Patent [19]

Dreyfus

[11] Patent Number: 5,974,616

[45] Date of Patent: Nov. 2, 1999

[54] SOUND PRODUCING TOOTHBRUSH

[76] Inventor: Edward Dreyfus, 181 Acorn Dr., Clark, N.J. 07066

[21] Appl. No.: 09/085,119

[22] Filed: May 26, 1998

[51] Int. Cl.[6] ..... A46B 9/04

[52] U.S. Cl. ..... 15/105; 15/167.1

[58] Field of Search ..... 15/105, 167.1, 15/143.1; 446/81, 404

[56] References Cited

U.S. PATENT DOCUMENTS

| | | | |
|---|---|---|---|
| 1,597,742 | 8/1926 | Turner | 15/105 |
| 2,126,858 | 8/1938 | Zadek | 15/105 |
| 2,154,209 | 4/1939 | Kohn | 15/167.1 |
| 2,877,477 | 3/1959 | Levin | 15/105 |
| 3,361,355 | 1/1968 | Renee | 15/105 |
| 4,001,909 | 1/1977 | Erickson et al. | 15/184 |

*Primary Examiner*—Mark Spisich
*Assistant Examiner*—Theresa T. Snider
*Attorney, Agent, or Firm*—Edward Dreyfus, Esq.

[57] ABSTRACT

A toothbrush combination including a whistle, horn, or other wind operated device releasably connected to or molded as part of the handle. The mouthpiece of the sound device can be aligned longitudinally with the toothbrush handle with the mouth engaging part facing opposite from the brush location or alternately the mouthpiece can be formed at a 90° angle to the longitudinal axis of the toothbrush handle and located intermediate the brush and the opposite end of the handle. Preferably the distal end of the handle is shaped to fit a standard toothbrush holder for storage in an upright position. When so stored, liquid is free to drain from the sound chamber for the latter to be air dried to reduce bacterial growth. The sound device is preferably sculptured to form a figure, logo, character, or object which sculpture also functions as a mouth guard or safety device against inward impact forces when blowing. This toothbrush provides a new and improved dental training or promotional toothbrush that is simple and inexpensive to make, is fun and safe to use, is easily cleaned and air dried, has a long lifetime, fits a standard toothbrush holder, and includes no moving parts.

23 Claims, 2 Drawing Sheets

SOUND PRODUCING TOOTHBRUSH

BACKGROUND

The present invention relates to toothbrushes and more particularly to a new and improved toothbrush combination comprising a toothbrush part in combination with a sound device that increases the functionality, enjoyment, and signalling capability of the combination. This new toothbrush combination has particular utility as a dental device for children and adults, a dental training device for children, a dental promotional device for anyone or any entity, and other utilities as well.

Various prior toothbrush designs are known that include sound devices for various purposes. Toothbrushes of these known types suffer from a number of technical and production problems that impede their marketability such as requiring moving parts, expensive manufacturing processes, expensive parts, batteries, and electrical components, short lifetimes of the sound device relative to the brush portion, separate sound control switch, and the like.

Some of these problems are purported to be overcome by the device disclosed in U.S. Pat. No. 4,001,909, dated Jan. 11, 1977. However, this prior disclosed toothbrush introduces additional problems, such as moving parts, more expensive manufacturing requirements, spaces to trap and hold moisture and liquids which produces mold and other living organisms, a handle design that interferes with the brushing action and can not fit a conventional toothbrush holder, can not be easily cleaned, does not provide a protective safety guard if the user falls with the sound device in his or her mouth.

SUMMARY OF EXEMPLARY EMBODIMENT OF THE PRESENT INVENTION

A toothbrush combination according to the principles of the present invention solves or avoids all the above mentioned problems and provides other advantages by including a toothbrush part having a handle or hand held extension and a sound device, such as a whistle, horn, or other wind operated device connected to or formed as part of the handle. In one example, the mouthpiece of the sound device is aligned longitudinally with the toothbrush handle with the mouth engaging part facing opposite from the brush location. In an alternate embodiment the mouthpiece is formed at an angle to the longitudinal axis of the toothbrush handle and located intermediate the brush and the opposite end of the handle. Preferably, the distal end of the handle is shaped to fit the standard opening of a conventional toothbrush holder or support for storage of the toothbrush in an upright position. When so stored, liquid is free to drain from the sound chamber and the wind inlet so that the sound device can be air-dried to reduce the growth of bacteria and mold.

The sound chamber includes an enlarged shell the outer surface of which preferably comprises a sculpture of any kind whatsoever such as a figure, logo, character, symbol, object or other representation which sculpture preferably also functions as a mouth guard or safety device more fully described below.

Accordingly, the toothbrush combination according to the principles of the present invention provides a new and improved dental training or promotional assembly that is simple and inexpensive to make, is fun and safe to use, is easily cleaned and air dried, has a long lifetime, fits a standard toothbrush holder for storage in an upright position, and includes no moving parts.

DRAWINGS

Other and further objects and advantages shall become apparent with the following detailed description when taken in view of the appended drawings, in which.

DETAILED DESCRIPTION OF EXEMPLARY EMBODIMENTS

Figure 1:
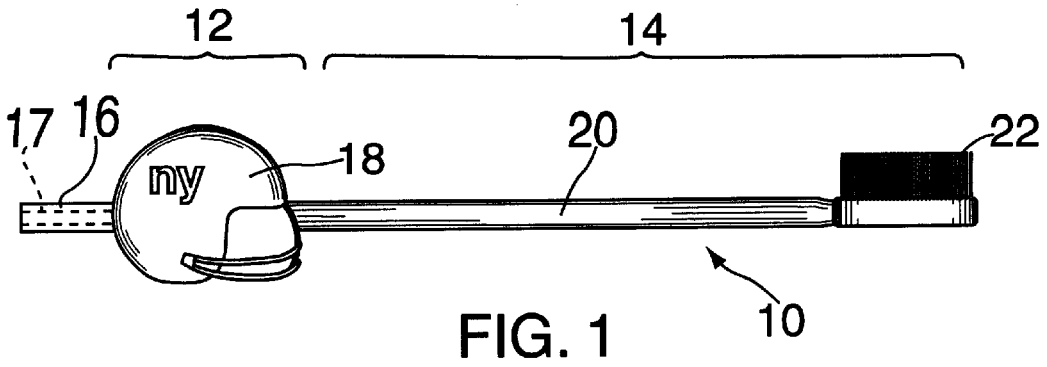
FIG. 1 is a side elevation of one exemplary embodiment according to the principles of the present invention.
Figure 2:
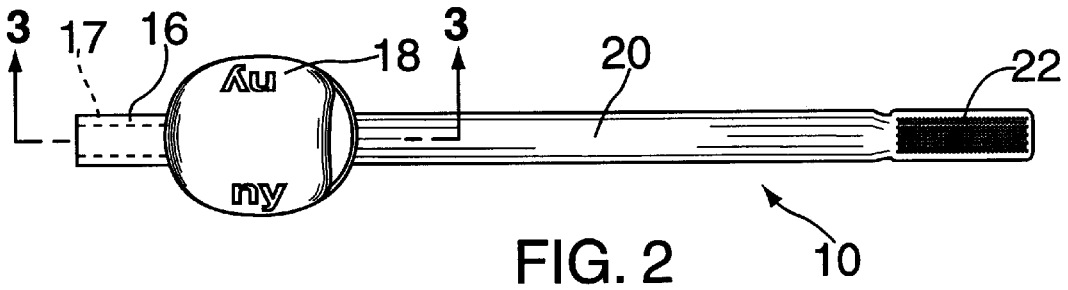
FIG. 2 is a top plan view of the embodiment of FIG. 1.
Figure 3:
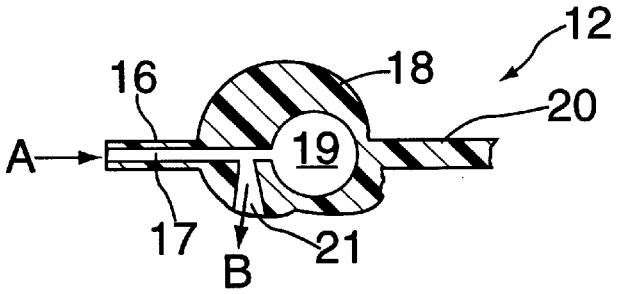
FIG. 3 is a partial side sectional view taken along line 3—3 of FIG. 2.

Referring to FIGS. 1–3, toothbrush 10, according to the principles of the present invention, includes a wind operated sound device 12 connected integrally with a toothbrush section 14. Section 14 comprises a longitudinal handle or extender 20 terminating in a brush part formed by upstanding bristles 22 secured in the extender in any suitable manner. Preferably, sound device 12 and extender 20 are made of plastic or other suitable material and molded as a single unitary piece.

Sound device 12 preferably comprises a hollow mouthpiece 16 connected to and communicating with a sound chamber shell 18 which in turn is fixed or integrally connected longitudinally to extender 20. Preferably mouthpiece 16 and extender 20 are axially aligned although they could have alternate relative orientations (not shown). Also, shell 18 is preferably generally symmetrically oriented on the longitudinal axis although it can have other orientations if desired.

As better seen in FIG. 3, device 12 includes a hollow mouth piece 16 with wind channel 17 extending to the left of shell 18. As better seen in FIG. 9, the length and dimensions of mouthpiece 16 preferably enable mouth piece 16 to be inserted into an opening of a standard toothbrush holder 2 commonly found in most homes throughout the nation and to enable the left most surface area of shell 18 to engage or rest on the top of the holder 2 to support the toothbrush in an upstanding or vertical position. Shell 18 forms a sound chamber 19 that communicates with wind channel 17 of mouthpiece 16. Shell 18 also defines a wind exit port 21. Chamber 19, port 21, and channel 17 are so dimensioned and shaped so as to produce a whistle, horn or sound blast when someone blows through mouthpiece 16. This action is represented by blown wind at arrow A and exit wind at arrow B. The selection of the design and dimension of channel 17, port 21, and chamber 19 to produce sound in this manner are well known and conventional.

As seen below, one utility of the toothbrush according to the present invention is as a dental training device for children. Accordingly, shell 18 outer surface area nearest mouthpiece 16 also functions as a safety device. That is, if a child falls while blowing on mouthpiece 16, shell 18 outer surface nearest mouthpiece 16 will impact the child's outer lips and forces shall be mostly absorbed by lips, gums and teeth instead of all the forces driving mouthpiece 16 toward the rear of the child's throat or pallet.

Toothbrush 10 is preferably formed of molded plastic using conventional molding machines and plastic or other suitable materials. Shell 18 is preferably shaped in the form of any desirable object, person, real or fictional character, symbol, animal, plant, bird, food, fish or mammal, whatsoever (hereinafter severally and collectively "object"). The exemplary embodiment of FIGS. 1–3 disclose shell 18 as a football helmet bearing a typical logo "NY" thereon. Forming shell 18 in a desirable or recognizable shape and as a sound device enhances the appeal and enjoyment of acquiring dental toothbrush 10 for the user. Shell 18 also functions in cooperation with the toothbrush as an enlargement for children to grip to aid brushing, as a safety device mentioned above, and as an advertising or promotional device by the copyright or trademark owner represented by the shape of shell 18.

Figure 9:
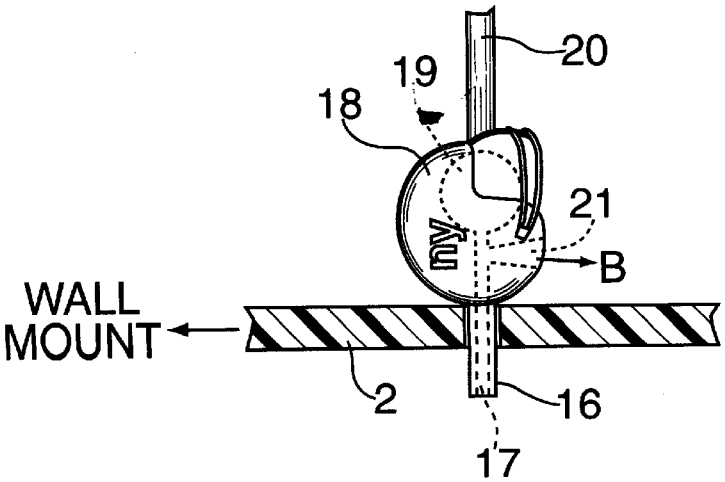
FIG. 9 is a partial section view of FIG. 1 in combination with a standard wall-mounted toothbrush holder.

In operation, the child or other person acquires toothbrush 10 from the toothbrush holder 2 (FIG. 9). If desired, the user can signal acquisition by inserting mouthpiece 16 into his/her mouth and blowing. A relatively loud sound, whistle, or blast will emanate from chamber 19 through port 21. The user can grip handle or extender 20 or alternately the user can grip shell 18 or grip shell 18 and handle 20 simultaneously. Shell 18 affords a larger grip to enable small hands to better grip and control the brushing action. Toothpaste can be applied to bristles 22 in the usual manner, and the user brushes his/her teeth in the normal way.

Upon completion, the user can rinse the entire toothbrush 10 and again operate the sound device to signal completion and replace in the toothbrush holder. Any liquid entering chamber 19 will drain out through channel 17 and any remaining moisture in chamber 19 will air dry because of the venting action between channel 17 and port 21. Of course, the user can operate the sound device at any other time as desired.

Figure 4:
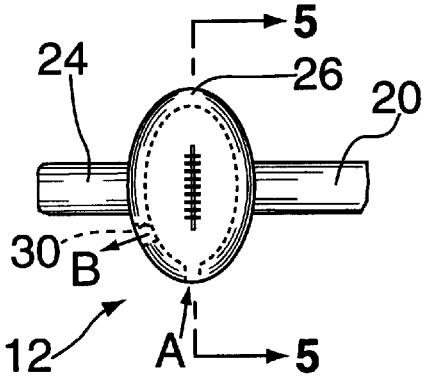
FIG. 4 is a partial top plan view of an alternate embodiment according to the principles of the present invention.
Figure 5:
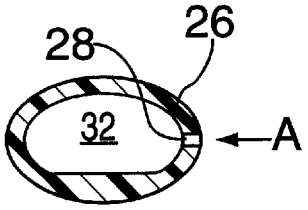
FIG. 5 is a side sectional view taken along line 5—5 of FIG. 4.

An alternate embodiment of sound device 12 as shown in FIGS. 4 and 5 that includes the shell 26 arranged with its axis at an angle, such as normal, to the axis of handle 20. A solid end piece 24 is formed at the distal end of the sound device to cooperate with the toothbrush holder 2 as stated above. Shell 26 forms chamber or cavity 32, mouthpiece channel 28 and exit port 30 to form a blast, tone, or whistle when the user blows wind A causing exit air flow B. Port 30 is preferably located near the bottom of shell 26 and the inner wall of chamber 32 is shaped to aid liquid drainage through port 30 when end piece 24 is inserted into toothbrush holder 2 (not shown in this figure). Shell 26 also provides the safety features as stated above for shell 18. Note that shell 18 can be any suitable shape, such as a football. Shell 26 and/or the handle functions as the safety device mentioned above.

The sound device and toothbrush handle/extender of all above mentioned exemplary embodiments can be molded as a single piece and with any desirable combination of materials and colors.

Figure 6:
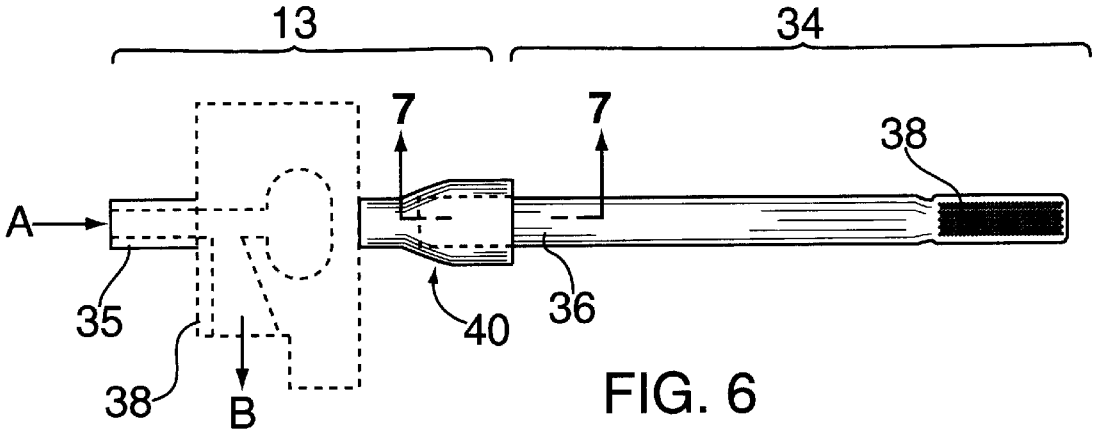
FIG. 6 is a top plan similar to FIG. 1 but of a further alternate embodiment according to the principles of the present invention.
Figure 7:
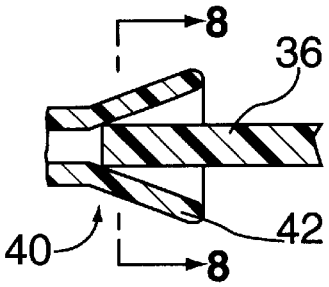
FIG. 7 is a side sectional view taken along line 7—7 of FIG. 6.
Figure 8:
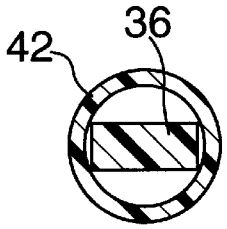
FIG. 8 is a front section taken along line 8—8 of FIG. 7.

A further alternate embodiment is shown in FIGS. 6, 7, and 8 that includes a toothbrush section 34 and a sound section 13. Dashed box 38 represents any desired object of a sound producing shell molded to the hollow distal end piece 35 and a toothbrush handle coupler 40. Coupler 40 comprises a hollow, plastic member, preferably having a horn or cone shaped member 42 opening and expanding to receive the end of a handle 36 of a conventional toothbrush. The conical shape of horn or cone 42 enables variously sized handles 36 to be force fitted into cone 42 for frictional retention between the inner walls of cone 42 and the outer edges of handle 36 end portion.

With the sound device 12 securely mated with handle 36 of toothbrush 34, the combination functions in the same manner described above. However, in the event toothbrush 34 bristles wear out or when desired, sound device 13 can be removed from toothbrush 34 handle 36 by longitudinally pulling the two parts apart with force sufficient to over-come the aforementioned frictional retention force. Sound device 13 can then be installed on a different toothbrush 34 as stated above or used separately as desired. Shell 38 defines the sound chamber that can communicate with the wind channel for inlet wind A and can also define the exit port for wind B, and shell 38 provides the safety device feature mentioned above.

It will be understood that various changes and modifications can be made to the herein disclosed exemplary embodiments without departing from the spirit and scope of the present invention.

I claim:

1. A toothbrush comprising a longitudinal handle having first and second portions, teeth cleaning bristles connected to said first portion, a mouth operated sound device connected to said second portion, said device defining (i) a sound chamber having a fixed size and shape, (ii) a wind inlet channel having a fixed size communicating with said chamber and (iii) a sound and wind outlet port communicating with said chamber, and wherein said chamber, inlet channel and outlet port being operatively fixed relative to each other and relative to said first portion.

2. A toothbrush according to claim 1 wherein said wind inlet channel is at a location transverse to the longitudinal axis of said handle, and in a direction such that the user faces transverse to the longitudinal handle when blowing wind through said inlet channel.

3. A toothbrush according to claim 2 wherein said outlet port is at a location wherein cleaning liquid drains from said chamber to exit said outlet port when the toothbrush is stored in an upright position.

4. A toothbrush comprising a longitudinal handle having first and second portions, teeth cleaning bristles connected to said first portion, a mouth operated sound device connected to said second portion, said device defining (i) a sound chamber having a fixed size and shape, (ii) a wind inlet channel having a fixed size communicating with said chamber and (iii) a sound and wind outlet port communicating with said chamber, and wherein said chamber, inlet channel and outlet port being operatively fixed relative to each other, and wherein said device includes a safety element for pressing upon the user's outer lips in a direction toward a user's teeth and gums in the event a force is applied on the toothbrush toward the user's mouth when a user's mouth engages that portion of the device that defines the wind inlet channel and thereby limit the extent to which said portion of the device that defines the wind inlet channel can enter the user's mouth.

5. A toothbrush according to claim 4 wherein said device includes a shell defining said sound chamber, and said safety element comprising a portion of said shell.

6. A toothbrush according to claim 5 wherein said second portion comprises a distal end substantially longitudinally aligned with the longitudinal axis of the handle, said distal end having a length and dimension for fitting through an opening of a toothbrush holder.

7. A toothbrush according to claim 6 wherein said safety element supports the toothbrush in generally an upright position when said distal end is inserted through the opening of a toothbrush holder and said safety element engages the top surface of the toothbrush holder.

8. A toothbrush according to claim 7 wherein said distal end defines the wind inlet channel, and said wind inlet channel assumes a generally upright position when the toothbrush is stored upright and wherein cleaning liquid within said chamber is free to drain through and exit the wind inlet channel when the toothbrush is stored upright.

9. A toothbrush according to claim 5 wherein said shell outer surface comprises a larger outer transverse circumference than that of said first portion.

10. A toothbrush according to claim 9 wherein said first and second portions and said device are connected together as a single unitary fixed piece.

11. A toothbrush according to claim 9 wherein said shell includes an outer surface in the form of an object.

12. A toothbrush according to claim 4 wherein said device includes a shell defining said sound chamber and wherein said shell includes an outer transverse circumference greater than the outer transverse circumference of said first portion.

13. A toothbrush according to claim 12 wherein said shell defines said wind inlet channel at a location transverse to the longitudinal axis of said handle, and wherein the user faces transverse to the longitudinal handle when blowing wind through said inlet channel.

14. A toothbrush according to claim 13 wherein said shell defines said outlet port at a location wherein cleaning liquid drains from said chamber to exit said outlet port when the toothbrush is stored in an upright position.

15. A toothbrush according to claim 13 wherein said first and second portions and said device are connected together as a single unitary fixed piece.

16. A toothbrush according to claim 13 wherein the outer surface of said shell is in the form of an object.

17. A toothbrush according to claim 5 wherein said first portion releasably engages said second portion.

18. A toothbrush according to claim 17 wherein said second portion comprises a coupler for frictionally and longitudinally engaging the distal unbristled end of a conventional toothbrush and said first portion comprises a conventional toothbrush having a distal unbristled end releasably secured to said coupler.

19. A toothbrush according to claim 18 wherein said coupler comprises a hollow horn having a larger end surrounding the distal unbristled end of said conventional toothbrush and a smaller end integral with said shell.

20. A toothbrush according to claim 19 wherein said shell outer surface forms an object.

21. A toothbrush according to claim 19 wherein said second portion comprises a distal end substantially longitudinally aligned with the longitudinal axis of said handle, said distal end having a length and dimension for fitting through an opening of a toothbrush holder.

22. A toothbrush according to claim 21 wherein said safety element supports the toothbrush in generally an upright position when said distal end is inserted through the opening of a toothbrush holder and said safety element engages the top surface of a toothbrush holder.

23. A toothbrush according to claim 22 wherein said distal end defines the wind inlet channel that assumes a generally upright position when the toothbrush is stored upright and wherein cleaning liquid within said chamber is free to drain through and exit said wind inlet channel.

* * * * *